US005692430A

United States Patent [19]

McLaughlin et al.

[11] Patent Number: 5,692,430

[45] Date of Patent: Dec. 2, 1997

[54] ARTICULATED PISTON APPARATUS INCLUDING A COOLING GALLERY

[75] Inventors: Samuel L. McLaughlin, Lafayette, Ind.; Stephen V. Kelly, Peoria, Ill.

[73] Assignee: Caterpillar Inc., Peoria, Ill.

[21] Appl. No.: 488,625

[22] Filed: Jun. 8, 1995

[51] Int. Cl.[6] ..... F01B 31/00

[52] U.S. Cl. ..... 92/159; 92/158; 92/190; 92/219; 123/193.6

[58] Field of Search ..... 92/158, 159, 160, 92/186, 189, 190, 219; 123/193.6

[56] References Cited

U.S. PATENT DOCUMENTS

| | | | |
|---|---|---|---|
| 4,011,797 | 3/1977 | Cornet | 92/186 |
| 4,180,027 | 12/1979 | Taylor | 92/186 |
| 4,593,660 | 6/1986 | Elsbett et al. | 123/193.6 |
| 4,794,848 | 1/1989 | Melchior | 92/160 |
| 4,867,119 | 9/1989 | Cooper et al. | 123/193.6 |
| 4,947,805 | 8/1990 | Steppat et al. | 92/186 |
| 5,040,454 | 8/1991 | Ballheimer et al. | 92/219 |

FOREIGN PATENT DOCUMENTS

| | | | |
|---|---|---|---|
| 56-52544 | 5/1981 | Japan | 123/193.6 |
| 58-5455 | 1/1983 | Japan | 123/193.6 |

*Primary Examiner*—Thomas E. Denion
*Attorney, Agent, or Firm*—David L. Polsley

[57] ABSTRACT

An articulated piston apparatus including an improved skirt member wherein the skirt member includes a cooling gallery channel with means for providing a directed flow of lubricant from the cooling gallery channel to the elements of the piston apparatus disposed within the skirt bore, wherein during the upward stroke of the piston apparatus a downwardly directed flow of lubricant flows from the cooling gallery channel through a bore from the cooling gallery channel to the skirt bore and therein impinges those elements of the piston apparatus to assure complete lubrication thereof.

8 Claims, 1 Drawing Sheet

ARTICULATED PISTON APPARATUS INCLUDING A COOLING GALLERY

TECHNICAL FIELD

This invention generally pertains to internal combustion engines, and more particularly to articulated piston apparatus suitable for use in internal combustion engines.

BACKGROUND ART

As is well known, piston-type internal combustion engines are employed in a wide variety of applications. In those applications requiring sustained output of torque, or lugging ability, rather than acceleration, it has been found that diesel-cycle engines offer superior performance. The typical configuration of the diesel engine used in high-output applications is the in-line, multiple cylinder configuration, having for example, 4 or 6 cylinders disposed with the axis of the cylinders in a vertical plane. While these engines have many advantages, these high-output diesel engines have traditionally had difficulties with excessive consumption of lubricating oil, and the discharge of excessive quantities of smoke or particulate matter. Both of these tendencies are undesirable, in that the consumption of oil leads to excessive operating cost, whereas the discharge of excessive particulate matter is environmentally undesirable. Furthermore, diesel engines have typically experienced problems with "blow-by" of combustion gases from the combustion chamber to the crankcase of the engine, which reduces the efficacy of the lubricating oil and reduces the acceptable interval between necessary oil changes, increasing operating costs and reducing the life of the engine.

In addressing these and other concerns related to the performance of these diesel engines, there has been a trend away from the one-piece or unitary piston to the use of the two-piece, articulated piston apparatus in diesel engines. The two-piece piston apparatus includes a head member and a skirt member. A piston apparatus composed of these two members displays distinct characteristics as opposed to those displayed by the one-piece, unitary piston apparatus. In the two-piece apparatus, the head member is in direct contact with the combustion gases and is responsive primarily to the forces exerted by and upon those combustion gases, whereas the skirt member primarily serves to guide the piston apparatus in its travel within the cylinder liner as well as to support the side loads incidental to the motions of the connecting rod. Because the skirt member is mechanically connected to but not integral to the head member, the skirt member remains cooler than the head member while the piston apparatus is being used, and it is less subject to thermal expansion effects. Conversely, as the mass of the head member is likewise less, it has been found desirable to provide additional cooling on the lower side of the head member to aid in the control of the head member operating temperature and the concomitant expansion and shape changes.

It has been found beneficial in the articulated piston apparatus to provide a cooling gallery between the piston head and the piston skirt member, which includes a cooling gallery channel in the form of an upwardly facing annular trough disposed at or near the upper edge of the skirt member. Lubricant collects in or is provided to the cooling gallery channel, and remains in the cooling gallery channel during the upward stroke of the piston apparatus. At the upper end of the piston stroke, the lubricant, due to the inertia imparted by the upward motion of the piston apparatus, continues upward, leaving the cooling gallery channel and impinging upon the under side of the head member. The lubricant provides an instant, transitional cooling of the head member.

It is well known that it is both desirable and necessary to provide lubricant to all the surfaces of components or elements which are in sliding or rotational contact or engagement, as the lubricant provides both a lubricating and cooling function. This includes, of course, the piston pin which links the piston apparatus to the connecting rod. The lubricant is supplied either by a pressurized spray of lubricant on the under side of the connecting rod, piston apparatus, or is forced through a bore the connecting rod and into grooves or slots provided in the piston pin bore of the connecting rod to lubricate the piston pin in the connecting rod bearing.

Lubricant spray impinging upon the lower side of the piston pin, the exposed lower surfaces of the surfaces of the piston head, the exposed lower surfaces of the piston skirt, and the connecting rod provide a cooling effect thereon, incidental to providing lubrication to those moving surfaces upon which the lubricant spray impinges. Likewise, the lubricant directed to the connecting rod bore may provide lubrication and cooling of the piston pin within the connecting rod bore. However, it is often difficult to provide lubricating oil upon the upper surfaces of the piston pin and the bearings connecting the piston apparatus to the piston pin in sufficient quantity to provide the desired cooling effect and to aid in the lubrication of those bearings.

Therefore, it is an object of the present invention to provide an articulated piston apparatus particularly suited for use in diesel-cycle internal combustion engines.

It is another object of the present invention to provide such an articulated piston apparatus as will provide improved lubrication of the members thereof during operation.

It is another object of the present invention to provide such an articulated piston apparatus as will provide a lubricant flow from the cooling gallery channel to the upwardly exposed surfaces of the piston pin during operation.

It is yet another object of the present invention to provide such an articulated piston apparatus as will operate with improved thermal performance.

It is another object of the present invention to provide such an articulated piston apparatus as will be relatively inexpensive and simple of manufacture.

It is a further object of the present invention to provide such an articulated piston apparatus as will provide such improved performance without increased maintenance requirements.

It is yet a further object of the present invention to provide such an articulated piston apparatus as will provide an increased usable operating life.

These and other objectives of the present invention will become apparent in the specification and claims that follow.

SUMMARY OF THE INVENTION

The subject invention is an improved articulated piston assembly having a piston skirt member including an annular cooling gallery channel including means for directing a cooling oil flow downwardly from the cooling gallery channel to the upwardly exposed surfaces of the piston pin and bearing surfaces of the head member, those means preferably being a bore defined in the skirt member from the cooling gallery channel downwardly to the inner surface of the skirt member.

DESCRIPTION OF THE PREFERRED EMBODIMENT

Figure 1:
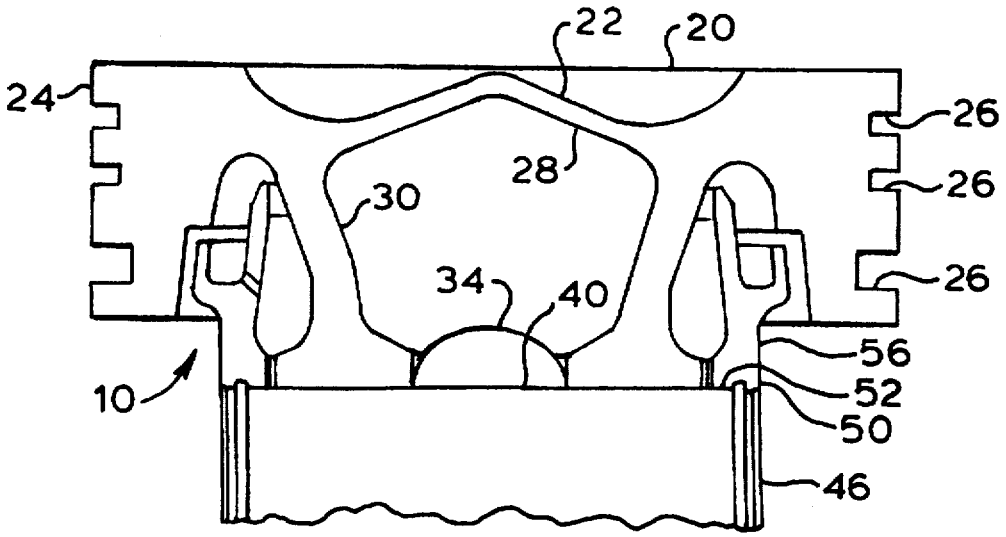
FIG. 1 shows a cross-sectional view of an articulated piston apparatus according to the present invention.

An articulated piston apparatus generally according to the present invention is shown in cross-sectional view in FIG. 1 and referred to with reference number 10. The articulated piston apparatus 10 includes a piston head member 20 and a piston skirt member 50. As is typical, the head member 20 includes a top land 22 and a cylindrical head side wall 24 in which a number of spaced apart and parallel concentric grooves 26 are defined. The concentric grooves 26 extend annularly around and co-axially with the head side wall 24 and are adapted to accept various rings employed in controlling the flow of lubricating oil from the crankcase to the combustion chamber and of the combustion, intake and exhaust gases from the combustion chamber to the crankcase during operation.

The crankcase, combustion chamber, and other components of the typical diesel engine in which the articulated piston apparatus 10 would preferably be utilized, although generically referred to herein, are not shown so as to avoid confusion, as those skilled in the relevant art will be readily familiar with those components, and those components do not as such constitute part of the invention disclosed herein. Furthermore, those skilled in the art will recognize that the articulated piston apparatus 10, as described herein, is primarily intended for use in multiple-cylinder, vertical in-line type engines, but that this should not be taken as limiting, since the subject invention may be suitably modified for use in other engine configurations. Finally, those skilled in the art will understand the terms "upper", "top", "lower", "upwardly", "downwardly", and so on, to refer to the use of the articulated piston apparatus 10 in a cylinder having a normally vertical axis with the crankcase below and the cylinder head above.

As shown in FIG. 1, the piston head member 20 includes a lower head surface 28 generally parallel to and spaced apart from the head top land 22. Two piston head support elements 30 depend from the lower head surface 28. Unlike the concentric grooves 26, the piston head support elements 30 do not extend annularly about the axis of the head side wall 24, but are parallel and spaced apart so as to permit the upper end of the connecting rod 34 to fit therebetween.

At the lower ends of each of the piston head support elements 30 are head support bores 36. The head support bores 36 are co-axially aligned on a horizontal axis intersecting the vertical axis of the head side wall 24, and also co-axially aligned with the connecting rod bore 40. There may be bearings disposed in the head support bores 36 and the connecting rod bore 40. Those skilled in the art will recognize that it is desirable to provide such bearings of materials as will tolerate the relatively large forces exerted thereon without substantial wear or damage.

A piston pin 46 extends through the horizontal axis of the head support bores 36 and the connecting rod bore 40 so as to mechanically link the connecting rod 34 and the articulated piston apparatus 10. For convenience of description, the piston pin 46 is described as the means for linking the skirt member 50 and the head member 20. Those skilled in the art will understand that other means may be employed without affecting the subject invention. The piston pin 46 therefore also extends beyond the head support bores 36 and the connecting rod bore 40 to mechanically link the piston skirt member 50.

The piston skirt member 50, as with the piston head member 20, is provided with skirt bores 52 for engaging the piston pin 46. The lower end 56 of the piston skirt member 50 is preferably disposed a cylindrical skirt guide wall (not shown) which is in sliding engagement with the cylinder wall to aid in guiding the articulated piston apparatus 10 within the cylinder.

Figure 2:
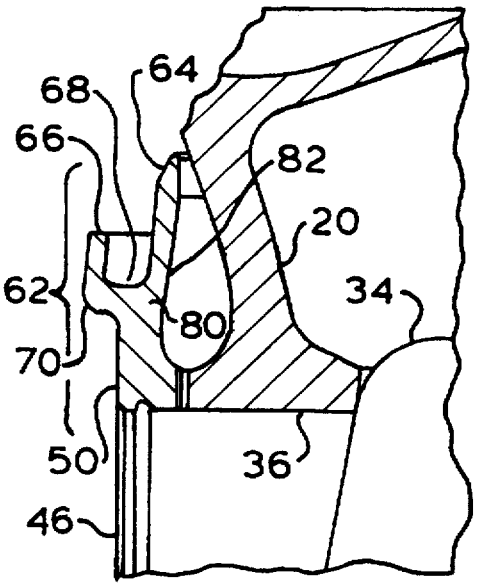
FIG. 2 shows an enlarged partial view of the cross-sectional view of FIG. 1 including the subject invention.

FIG. 2 shows an enlarged view of the preferred embodiment of the piston skirt member 50. The skirt member 50 more particularly includes a skirt body 60 and a cylindrical upper end portion 62. The skirt upper end portion 62 is co-axial with the piston head member 20 and includes an upwardly extending inner gallery channel wall 64, an upwardly extending outer gallery channel wall 66, and a generally horizontal gallery channel base 68. Together these comprise the cooling gallery channel 70, which extends around the cylindrical upper end portion 62. The skirt body 60 is further defined by an inner skirt wall 72 and an outer skirt wall 74, both of which are preferably substantially cylindrical, with the outer skirt wall 74 sized to fit within the cylinder in which the articulated piston apparatus 10 operates and the inner skirt wall 72 sized to freely accept therein the piston head support elements 30.

According to the preferred embodiment, means for downwardly discharging lubricating oil from the upwardly-facing cooling gallery channel 70 through the skirt body 60 of the piston skirt member 50 is a lubricant passage 80 is defined by a bore from the cooling gallery channel 70 through the inner skirt wall 72 of the skirt body 60. The passage 80 intersects the cooling gallery channel 70 in the gallery channel base 68 adjacent the inner gallery channel wall 64, and angles downwardly inwardly through the skirt body 60 toward the inner skirt wall 72. The preferred range of the downward angle of the lubricant passage 80 with respect to the gallery channel base 68 is, for example, between 20 and 90 degrees. The preferred downward angle of the lubricant passage 80 is dependent upon the geometry of the piston apparatus 10 in which it is employed, and is that angle which intersects the exposed upper surfaces of the piston pin 46. The lubricant passage 80 is preferably a cylindrical bore of relatively small diameter as is typically formed by a metal drill, the typical diameter being in the range of 2 to 6 millimeters. The typical diameter of the lubricant passage 80 also is dependent upon the geometry of the piston apparatus 10 in which it is employed, however, this diameter also determines the quantity of lubricant which may flow from the cooling gallery channel 70.

The axis of the lubricant passage 80 is preferably directly above and co-planar with the axis of the piston pin 46. Two lubricant passages 80 are provided in the skirt member 50 at positions which are radially removed 180 degrees. The use of two passages 80 at radially opposed positions ensures symmetry of the articulated piston apparatus 10, and therefore aids in maintaining the balance of forces exerted upon the connecting rod 34 and the piston pin 46.

In the operation of the subject invention, the improved articulated piston apparatus 10 is moved repeatedly up and down the axis of the cylinder in response to the forces exerted upon the articulated piston apparatus 10 by the combustion gases and the action of the connecting rod 34. A substantially constant spray of lubricating oil is directed upwardly against the exposed lower surfaces of the articulated piston apparatus 10. As the articulated piston apparatus 10 moves downward, a quantity of lubricating oil collects in the cooling gallery channel 70. The oil thus collected is retained in the cooling gallery channel 70 during the upward movement of the articulated piston apparatus 10. A quantity of the oil flows from the cooling gallery channel 70 through the lubricating passage 80 and is discharged therefrom onto the upper surfaces of the head support elements 30 and the piston pin 46.

The quantity of oil discharged through the lubricant passage 80 varies in response to the vertical motion of the articulated piston apparatus 10. During the downward stroke of the articulated piston apparatus 10, lubricating oil is typically flowing toward and into the cooling gallery channel 70. The articulated piston apparatus 10 descends more rapidly than the speed of the otherwise falling oil, such that no oil effectively passes through the lubricating passages 80. During the upward stroke of the articulated piston apparatus 10, however, both the inertia of the oil and the force of gravity acting upon the oil tend to force oil through the passage 80, and the oil is forced through the passage 80 with substantial speed and force, and in a relatively greater quantity.

The preferred size of the lubricating passage 80 is relatively small, for example, a bore of approximately 3.5 mm diameter may be entirely adequate for use in a typical articulated piston apparatus 10. Although a quantity of oil is discharged from the cooling gallery channel 70 is sufficient to materially aid in the lubrication and cooling of the piston pin 46 and the piston head support elements 30, the quantity of oil so discharged is not sufficient to materially reduce the quantity of oil in the cooling gallery channel 70, especially since the upwardly directed spray continually aids in recharging and refilling the cooling gallery channel 70.

Figure 3:
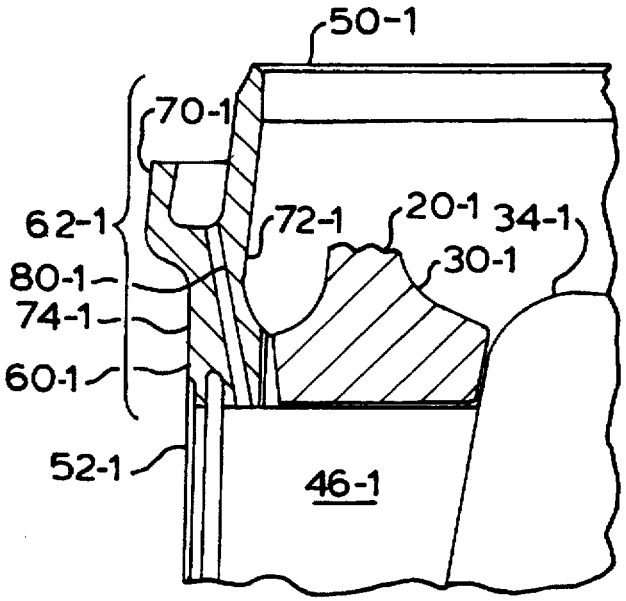
FIG. 3 shows an alternative embodiment of the subject invention in an enlarged partial view.

An alternative embodiment of the subject invention is disclosed in FIG. 3. Where the same item or feature is shown in more than one embodiment, it is labeled with the corresponding reference numeral to aid in the understanding of the subject invention. Reference should be had to all of the Figures necessary to aid in the understanding of the specification even where a particular Figure is referred to, as all reference numerals are not displayed in all Figures in order to minimize confusion and aid in clarifying the subject invention.

Turning then to FIG. 3, the piston skirt member 50-1 is shown in an enlarged partial cross-sectional view. The lubricant passage 80-1 again angles downwardly and inwardly. In this embodiment, the passage 80-1 intersects the skirt bore 52-1, ensuring a flow of lubricant from the cooling gallery channel 70-1 to lubricate the piston pin 46-1 in the skirt bore 52-1.

In operation, the alternative embodiment of the passage 80-1 performs in a substantially similar manner to the preferred embodiment, differing in the lubricating oil is primarily supplied to the piston pin 46-1 where it contacts the skirt bores 52-1.

The subject invention provides substantial advantages over the prior art. The lubricant passage 80 assures a flow of oil from the cooling gallery channel 70 which impinges upon the upwardly exposed surfaces of the connecting rod 34, the piston pin 46, and the upwardly exposed surfaces of the piston head support members 30. The impinging oil thus both cools and lubricates these elements, lengthening the life of these components and thereby reducing the maintenance costs of the articulated piston apparatus 10. Furthermore, the lubricant passage 80 is a relatively simple addition to the articulated piston apparatus 10 during the manufacture thereof, adding little to the time or expense of manufacture.

Modifications to the preferred embodiment of the subject invention will be apparent to those skilled in the art within the scope of the claims that follow:

What is claimed is:

1. A piston skirt member for use in an articulated piston member, said piston skirt member comprised of an upper end portion defining an upwardly facing cooling gallery channel including an inner gallery channel wall, a gallery channel base, and an outer gallery channel wall, said piston skirt member further having a lubricant passage for downwardly discharging lubricant from the cooling gallery channel through said piston skirt member, said lubricant passage intersecting said gallery channel base adjacent said inner gallery channel wall, said lubricant passage further angling downwardly in said skirt member and intersecting an inner skirt wall of said piston skirt member.

2. A piston skirt member as set forth in claim 1 wherein said lubricant passage angles downward with respect to the gallery channel base within the range of 20 and 90 degrees.

3. A piston skirt member as set forth in claim 2 wherein said lubricant passage is a cylindrical bore.

4. A piston skirt member as set forth in claim 3 wherein the cylindrical bore has a diameter in the range of 3 to 4 millimeters.

5. A piston skirt member as set forth in claim 1 wherein said lubricant passage angles downwardly in said skirt member and intersects a skirt bore of said piston skirt member for cooling and lubricating said piston pin in said skirt bore.

6. A piston skirt member as set forth in claim 5 wherein said lubricant passage is a cylindrical bore.

7. An articulated piston apparatus for use in internal combustion engines, said articulated piston apparatus comprised of:

a piston head member; and a piston skirt member, said piston skirt member including a skirt body having an upper end portion, said upper end portion including an inner gallery channel wall, a gallery channel base, and an outer gallery channel wall defining an upwardly facing cooling gallery channel, said upper end portion further including a lubricant passage for downwardly discharging lubricant from the cooling gallery channel through said piston skirt member, said lubricant passage further including a cylindrical bore intersecting said gallery channel base, angling downwardly in said skirt member and intersecting an inner skirt wall of said piston skirt member.

8. An articulated piston apparatus as set forth in claim 7 wherein said lubricant passage is a cylindrical bore intersecting said gallery channel base, angling downwardly in said skirt member, said lubricant passage having an axis above an axis of said piston pin and intersecting a skirt bore of said piston skirt member for cooling and lubricating said piston pin in said skirt bore.

* * * * *